US009105998B2

(12) United States Patent
Uno et al.

(10) Patent No.: US 9,105,998 B2
(45) Date of Patent: Aug. 11, 2015

(54) CONNECTOR

(75) Inventors: Masafumi Uno, Yokkaichi (JP); Manabu Uesato, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 67 days.

(21) Appl. No.: 14/006,711

(22) PCT Filed: Apr. 3, 2012

(86) PCT No.: PCT/JP2012/059052

§ 371 (c)(1),
(2), (4) Date: Sep. 23, 2013

(87) PCT Pub. No.: WO2012/137766

PCT Pub. Date: Oct. 11, 2012

(65) Prior Publication Data

US 2014/0017947 A1 Jan. 16, 2014

(30) Foreign Application Priority Data

Apr. 5, 2011 (JP) ..... 2011-083482

(51) Int. Cl.
*H01R 13/405* (2006.01)
*H01R 13/631* (2006.01)
(Continued)

(52) U.S. Cl.
CPC ..... *H01R 13/405* (2013.01); *H01R 13/6315* (2013.01); *H01R 13/5219* (2013.01); *H01R 13/6215* (2013.01); *H01R 24/86* (2013.01); *H01R 2105/00* (2013.01)

(58) Field of Classification Search
CPC ..... H01R 13/6315
USPC ..... 439/2, 383, 384, 247, 248, 32, 33
See application file for complete search history.

(56) References Cited

U.S. PATENT DOCUMENTS 8,408,927 B2 * 4/2013 Tashiro ..... 439/247
8,827,745 B2 * 9/2014 Tsujii et al. ..... 439/587
(Continued)

FOREIGN PATENT DOCUMENTS

JP 55-26594 7/1980
JP 8-279945 10/1996
(Continued)

OTHER PUBLICATIONS

International Search Report of Jul. 10, 2012.

*Primary Examiner* — Ross Gushi
(74) *Attorney, Agent, or Firm* — Gerald E. Hespos; Michael J. Porco; Matthew T. Hespos

(57) ABSTRACT

A device-side connector (10) is connected to a wire-side connector (50) by being mounted into a shield case (14) of a device (11) including a base member (12) and the shield case (14) fixed to the base member (12), and includes first terminals (21), a first housing (25) fixed in position with respect to the base member (12) and configured to hold the first terminals (21), second terminals (22) connected to the first terminals (21) via flexible conductive members (23), and a second housing (33) configured to hold the second terminals (22) and engageable with the first housing (25) with a predetermined clearance (CL) defined therebetween by the engagement of engaging frames (30) of the first housing (25) and engaging protrusions (40A) of the second housing (33).

6 Claims, 15 Drawing Sheets

(51) Int. Cl.

| | |
|---|---|
| *H01R 13/52* | (2006.01) |
| *H01R 13/621* | (2006.01) |
| *H01R 24/86* | (2011.01) |
| *H01R 105/00* | (2006.01) |

(56) References Cited

U.S. PATENT DOCUMENTS

| | | | | |
|---|---|---|---|---|
| 2007/0032112 | A1* | 2/2007 | Renautt et al. | 439/246 |
| 2007/0218736 | A1* | 9/2007 | Takizawa et al. | 439/247 |
| 2008/0296133 | A1* | 12/2008 | Ura | 200/1 A |
| 2008/0299785 | A1* | 12/2008 | Myatt et al. | 439/32 |
| 2011/0294326 | A1* | 12/2011 | Tanaka et al. | 439/248 |
| 2012/0040553 | A1* | 2/2012 | Tashiro | 439/359 |
| 2012/0142232 | A1* | 6/2012 | Yin et al. | 439/817 |
| 2012/0164893 | A1* | 6/2012 | Mitsuzuka et al. | 439/692 |
| 2013/0065426 | A1* | 3/2013 | Yamashita et al. | 439/449 |
| 2013/0130515 | A1* | 5/2013 | Huettner et al. | 439/59 |
| 2013/0316573 | A1* | 11/2013 | Uno et al. | 439/573 |
| 2014/0004740 | A1* | 1/2014 | Uno et al. | 439/607.58 |
| 2014/0017947 | A1* | 1/2014 | Uno et al. | 439/626 |
| 2014/0024266 | A1* | 1/2014 | Kashiwada et al. | 439/686 |

FOREIGN PATENT DOCUMENTS

| | | |
|---|---|---|
| JP | 10-228939 | 8/1998 |
| JP | 11-265740 | 9/1999 |
| JP | 2000-82518 | 3/2000 |
| JP | 2000-277217 | 10/2000 |
| JP | 2011-34935 | 2/2011 |
| WO | 2011/016272 | 2/2011 |

* cited by examiner

CONNECTOR

BACKGROUND

1. Field of the Invention

The present invention relates to a connector.

2. Description of the Related Art

Conventionally, a connector is known which prevents a trouble in connector connection due to a dimensional accuracy error or the like (see Japanese Unexamined Patent Publication No. 2000-277217).

A trouble due to a dimensional accuracy error or the like occurs not only when a connector is connected. Specifically, there is a case where a connector 1 is fixed to a base member 2 via an inner device 3 and a shield case 4 covering the inner device 3 is also fixed to the base member 2 as shown in FIG. 15, for example, in a device such as an inverter of a vehicle. In this case, if it is attempted to mount the shield case 4 on the base member 2 to guide the connector 1 into a tubular opening 5 of the shield case 4, a trouble such as inability to pass the connector 1 into the tubular opening 5 may occur in mounting the shield case 4 due to a dimensional accuracy error or the like between the tubular opening 5 and the position of the connector 1.

The present invention was completed based on the above situation and aims to provide a connector capable of preventing a trouble in mounting a case.

SUMMARY OF THE INVENTION

The present invention is directed to a connector to be connected to a mating connector by being mounted into a case of a device including a base member and the case fixed to the base member, including a first terminal; a first housing fixed in position with respect to the base member and configured to hold the first terminal; a second terminal connected to the first terminal via a flexible conductive member; and a second housing configured to hold the second terminal and engageable with the first housing with a predetermined clearance defined therebetween.

If both the case and the connector are fixed to the base member, an assembling trouble may occur due to a dimensional accuracy error or the like in mounting the connector into the case. On the other hand, according to this configuration, the case and the first housing are both fixed to the base member, but the second housing is engaged with the first housing with the predetermined clearance defined therebetween. Thus, even if a dimensional accuracy error or the like occurs between the case and the connector in mounting the case, the second housing is engaged with the first housing within the range of the predetermined clearance, whereby a displacement of the second housing is permitted according to the predetermined clearance and the dimensional accuracy error between the case and the device-side connector can be resolved. Thus, a trouble in mounting the case due to a dimensional accuracy error or the like can be prevented.

Further, since the second terminal held in the second housing is connected to the first terminal held in the first housing via the flexible conductive member, the second terminal can follow a displacement of the second housing even if the second housing is displaced from the first housing, and a trouble and the like at the time of connector connection due to the position of the second terminal can also be prevented.

It is more preferable to have the following configurations in addition to the above configuration.

The predetermined clearance is formed by the engagement of an engaging recess provided on one of the first and second housings and an engaging protrusion provided on the other of the first and second housings.

This enables the second housing to be engaged with the first housing with the predetermined clearance defined therebetween by a simple configuration.

The second housing is formed with a tapered surface capable of coming into contact with the case in mounting the case.

This enables the second housing to be displaced to a position where the case is mountable when the case comes into contact with the tapered surface even if the case is displaced from the connector in being mounted.

The first terminal is fixed to the holder fixed in position with respect to the base member.

According to the present invention, it is possible to prevent a trouble in mounting a connector into a case.

DETAILED DESCRIPTION OF THE PREFERRED EMBODIMENT

Hereinafter, a connector according to a specific first embodiment of the present invention is described with reference to FIGS. 1 to 14.

Figure 1:
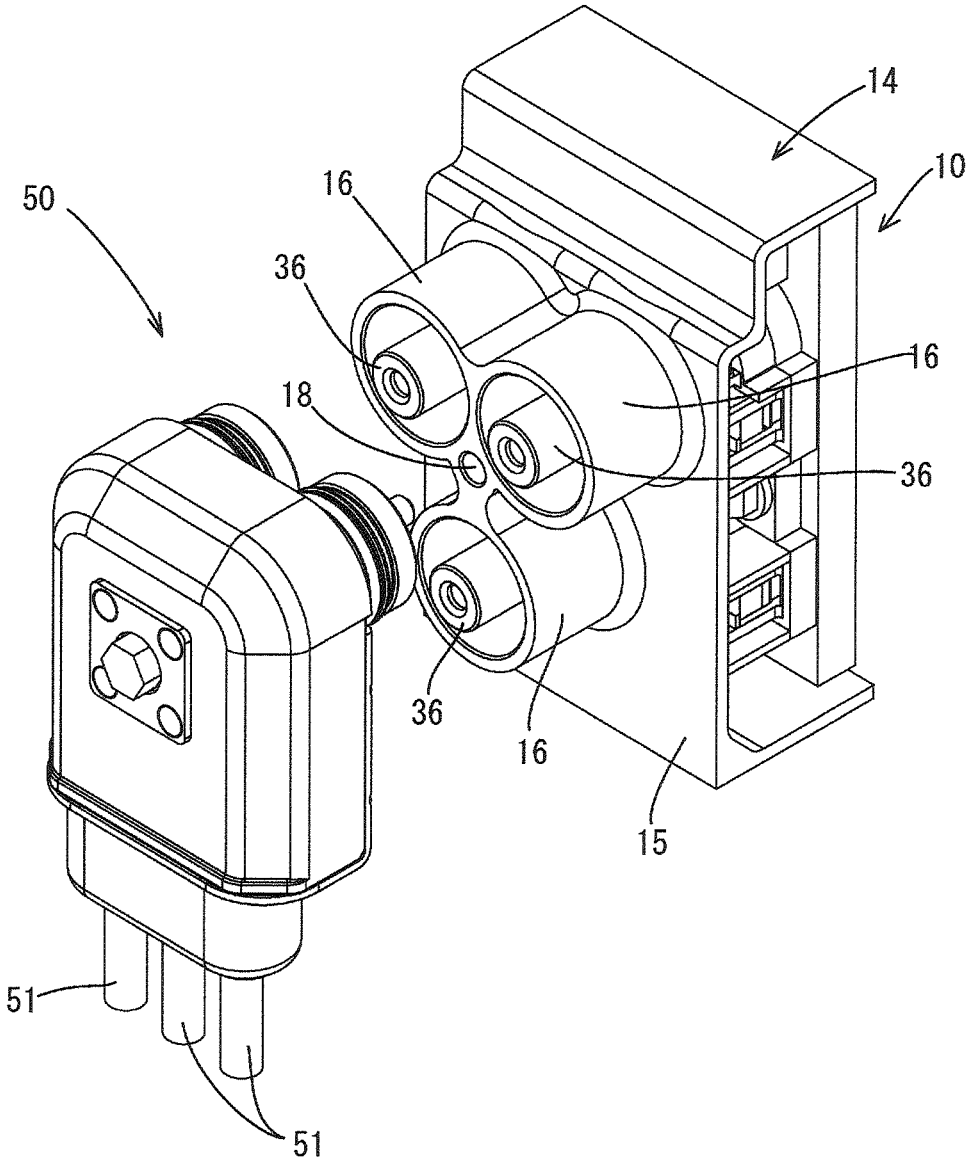
FIG. 1 is a perspective view showing a state where a wire-side connector and a device-side connector mounted in a shield case are facing each other.

A device-side connector 10 (an example of a "connector" of the present invention) of this embodiment is a connector provided in an inverter device of a vehicle such as a hybrid vehicle or an electric vehicle and, and a wire-side connector 50 (an example of a "mating connector" of the present invention) mounted on ends of wires 51 connected to a motor (generator) is fitted and connected thereto as shown in FIG. 1. In the following description, a vertical direction is based on FIG. 2 and a connector connecting direction of FIG. 2 is referred to as a forward direction.

Figure 2:
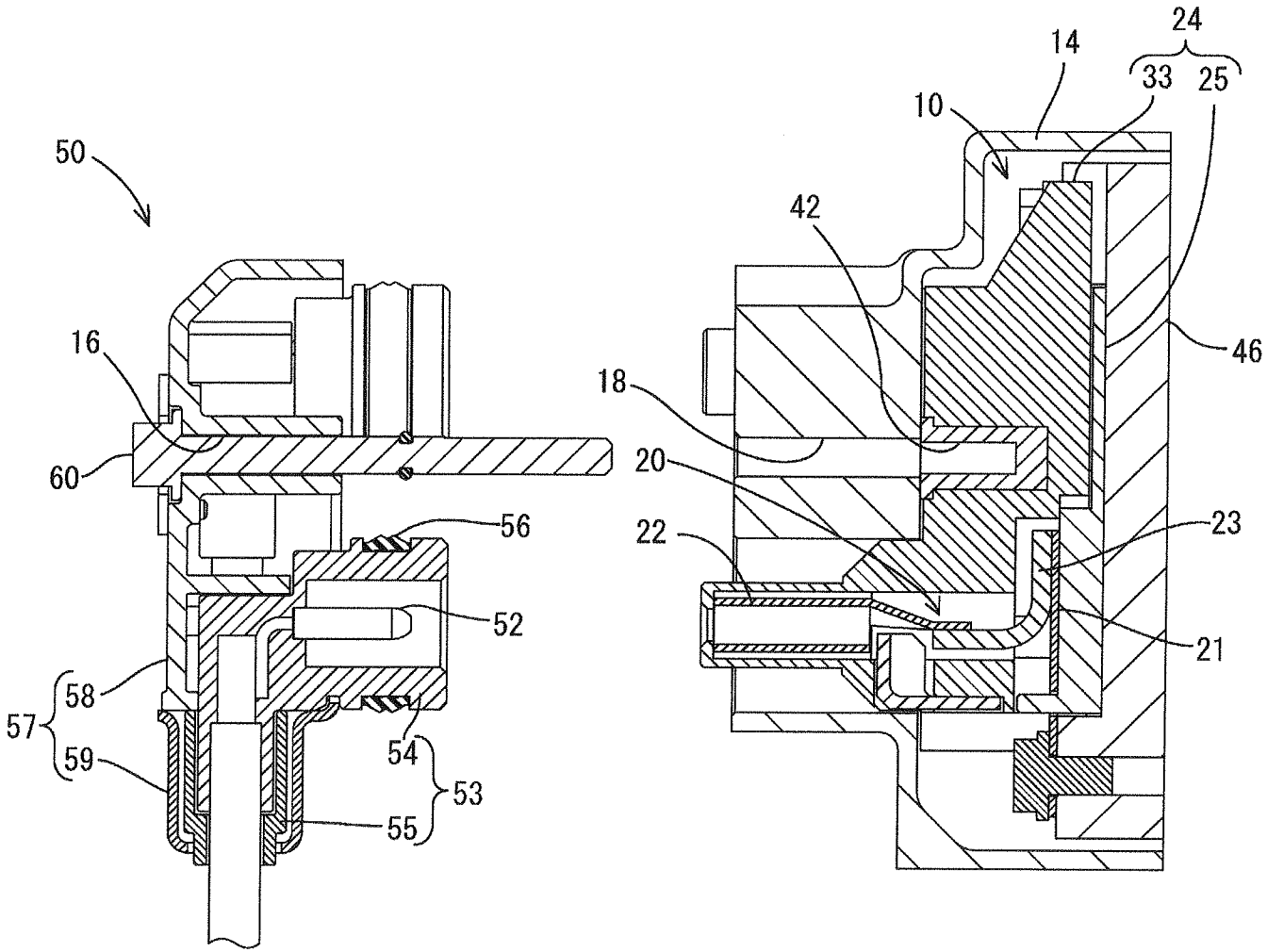
FIG. 2 is a vertical section of a widthwise intermediate part of FIG. 1.
Figure 3:
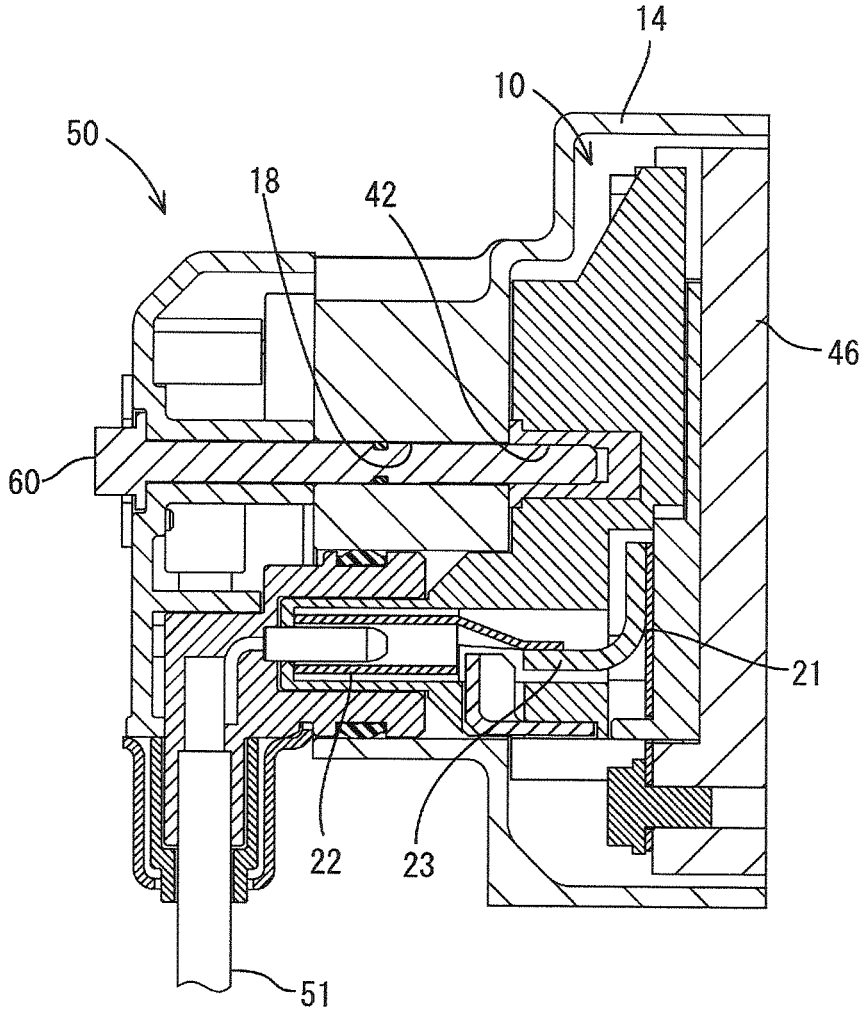
FIG. 3 is a vertical section showing a state where the wire-side connector and the device-side connector mounted in the shield case shown in FIG. 2 are connected.

The wire-side connector 50 is mounted on the ends of the wires 51 connected to the motor (generator) or the like of the vehicle and includes, as shown in FIG. 2, three terminal fittings 52 connected to the ends of three wires 51 capable of transmitting a three-phase AC current, a wire-side housing 53 for holding the terminal fittings 52 and a shield portion 57 for covering the wire-side housing 53.

The terminal fittings 52 are connected to conductor parts exposed at the ends of the wires 51.

The wire-side housing 53 is composed of a resin molded portion 54 for covering connected parts of the wires 51 and the terminal fittings 52 and a spacer 55 for holding the three wires 51.

The resin molded portion 54 includes a tubular fitting portion into which tip sides of the terminal fittings 52 project. A rubber ring 56 for sealing is mounted around the tubular fitting portion.

The shield portion 57 includes a shield shell 58 for shielding an upper side and a shield bracket 59 for shielding a lower side.

The shield shell 58 is provided with insertion tube portions 16 through which bolts 60 for holding a connected state of the two connectors 10, 50 are inserted.

The shield bracket 59 includes a plate-like shield portion for covering the front surface side of a housing 24 and a tubular shield portion for covering the spacer 55, and the plate-like shield portion is screwed to the shield shell 58.

Figure 4:
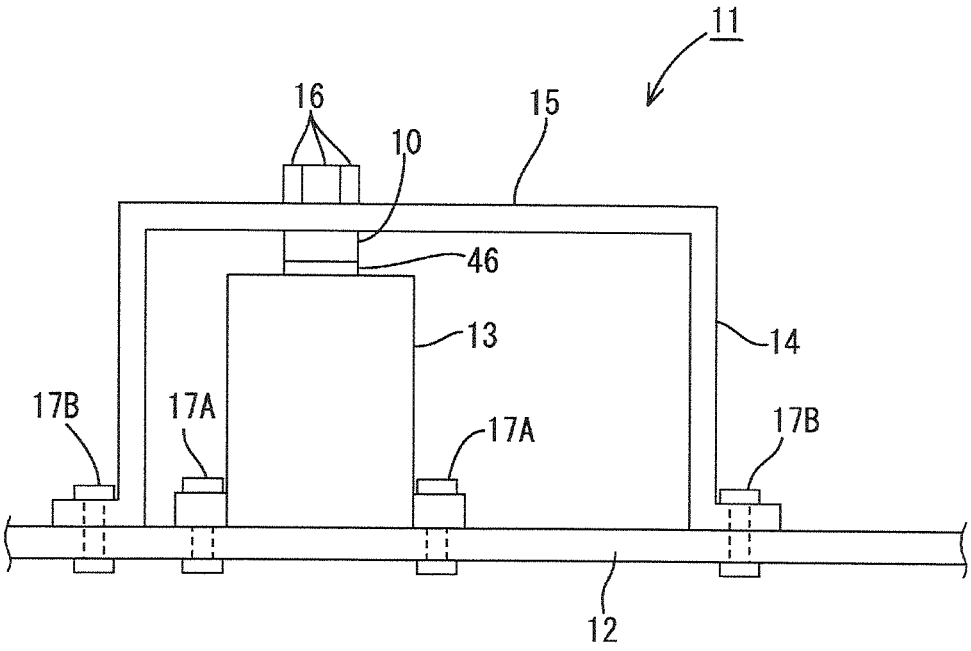
FIG. 4 is a view showing a schematic configuration of a device.

As schematically shown in FIG. 4, the device-side connector 10 is a connector which is mounted in a shield case 14 (an example of a "case" of the present invention) of a device 11 such as an inverter device and guided out from the interior of the shield case 14.

The device 11 includes a base member 12 made of a metal plate material, an inner device 13 such as a circuit fixed to the upper surface of the base member 12, and the shield case 14 fixed to the base member 12.

The inner device 13 is fixed to the base member 12 by fixing means 17A such as bolts and a holder 46 for holding the device-side connector 10 is fixed to an upper part of the inner device 13.

The shield case 14 is made of metal such as aluminum or aluminum alloy and fixed to the base member 12 by fixing means 17B such as bolts, and includes a box-shaped plate-like portion 15 and three tube portions 16 for connecting the device-side connector 10 to the outside.

The plate-like portion 15 is bent to have such a size as to be able to cover the inner device 13.

Each tube portion 16 is in the form of a cylinder projecting from the plate-like portion 15 as shown in FIG. 1.

A circular insertion hole 18, through which the bolt 60 is inserted, is formed to penetrate through a central part of the three tube portions 16 integrally connected to each other. Tubular accommodating portions 36 of the housing 24 to be described later are arranged inside the tube portions 16.

Note that this shield case 14 is shown only over a predetermined width including the tube portions 16 in FIG. 1 and other parts (other parts including a part fixed to the base member 12) are not shown (shown in a manner that the other parts are cut off).

As shown in FIG. 2, the device-side connector 10 includes electrically conductive connecting members 20 and the housing 24 for holding the connecting members 20.

Figure 5:
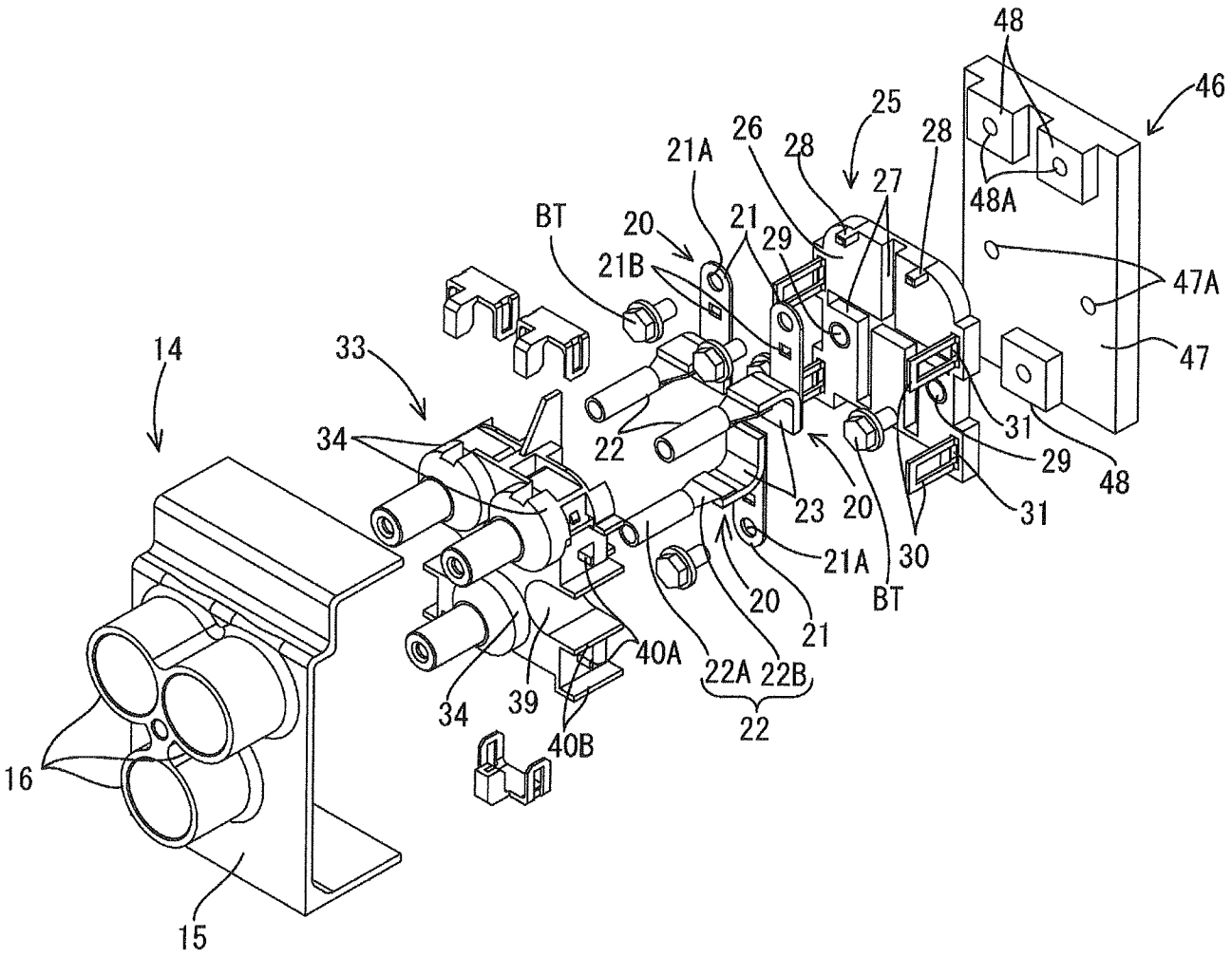
FIG. 5 is an exploded perspective view showing the shield case, the device-side connector and a holder.
Figure 6:
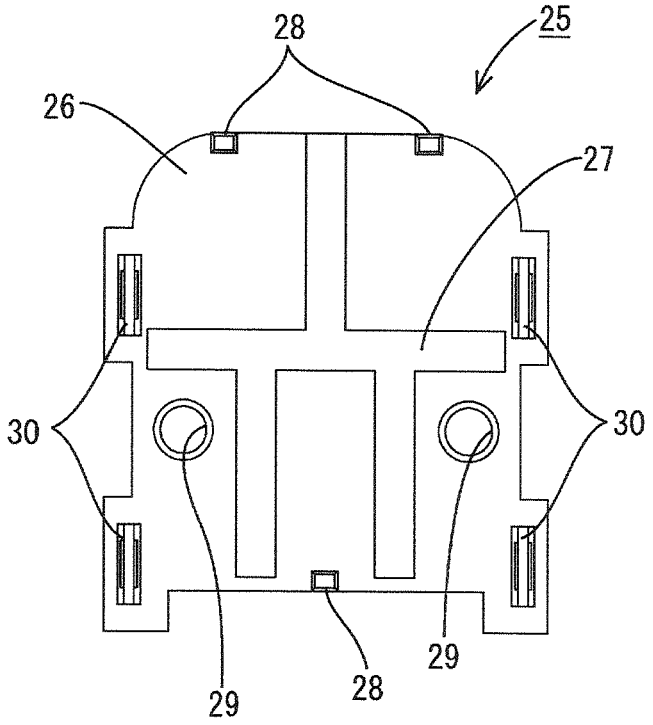
FIG. 6 is a front view showing a first housing.
Figure 7:
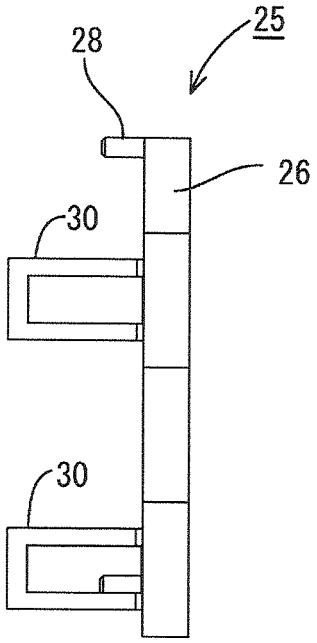
FIG. 7 is a side view showing the first housing.
Figure 8:
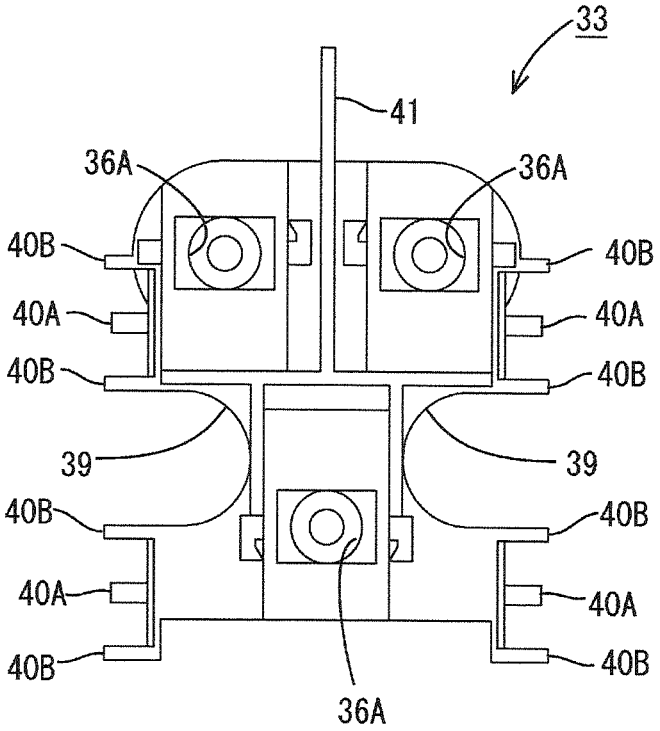
FIG. 8 is a front view showing a second housing.
Figure 9:
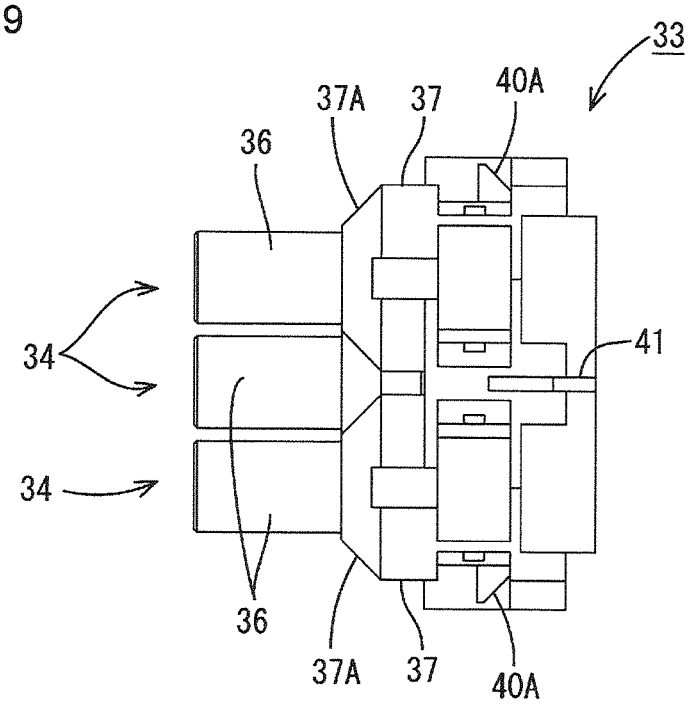
FIG. 9 is a plan view showing the second housing.
Figure 10:
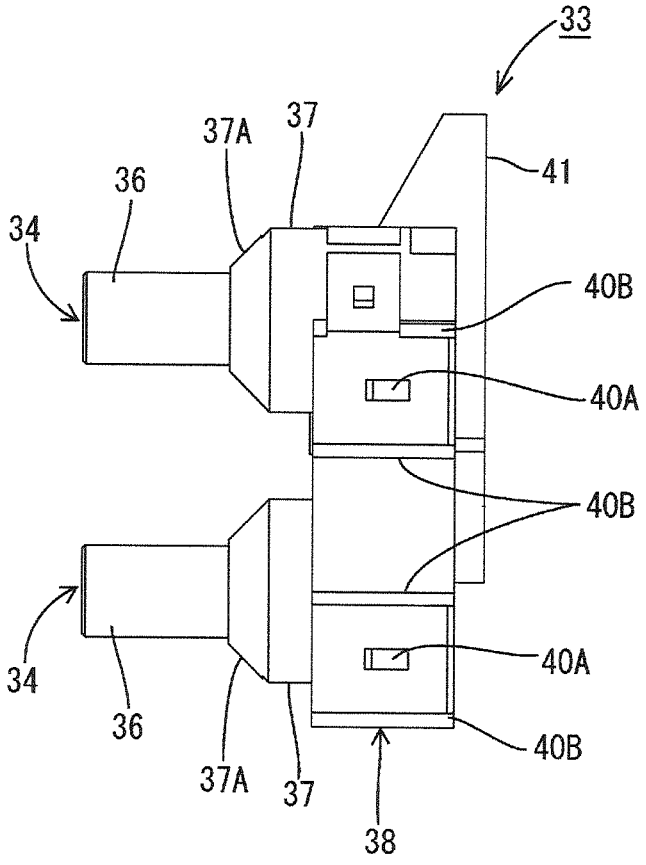
FIG. 10 is a side view showing the second housing.

As shown in FIG. 5, the connecting members 20 are provided at three positions: two positions in an upper part of the housing 24 and at one position in a lower part and each of them includes a first terminal 21 extending in the vertical direction, a flexible conductive member 23 one end side of which is connected to the first terminal 21, and a second terminal 22 connected to the other end side of the flexible conductive member 23 and extending in forward and backward directions. In this way, the second terminal 22 is connected to the first terminal 21 via the flexible conductive member 23.

The first terminal 21 is a plate-like member and an upper end side thereof serves as a terminal fixing portion. A circular terminal fixing hole 21 penetrates through this terminal fixing portion and a rectangular locking hole 21B penetrates therethrough at a position side by side with the terminal fixing hole 21A at a side closer to a base end side than the terminal fixing hole 21A.

The base end side of the first terminal 21 (base end side of the terminal fixing portion) serves as a connecting portion to which the flexible conductive member 23 is to be connected.

The flexible conductive member 23 is a flexible conductor. For example, various flexible members such as braided wires formed by braiding metal thin wires into a mesh, the wires 51 and copper foils can be used as such. This flexible conductive member 23 is connected while being placed on the respective terminals 21, 22 by one of known various connection means such as brazing and soldering and welding.

The second terminal 22 is shaped to be long in forward and backward directions and composed of a tubular terminal connecting portion 22A and a plate-like connecting portion 22*b* extending behind the terminal connecting portion 22A and to be connected to the flexible conductive member 23.

The housing 24 is made of synthetic resin and includes a first housing 25 arranged on a rear side and a second housing 33 arranged on a front side, configured to hold the second terminals 22 and engageable with the first housing 25 with a predetermined clearance CL defined therebetween.

The first housing 25 is fixed in position to the base member 12 via the holder 46 and the like and includes a plate-like terminal holding wall 26 for holding the first terminals 21 and engaging frames 30 (an example of an "engaging recess" of the present invention) projecting forward from left and right end parts of the terminal holding wall 26.

The terminal holding wall 26 includes groove portions 27 extending in the vertical direction and the lateral direction on the front surface side, locking protrusions 28 to be engaged with the locking holes 21B of the first terminals 21, and fixing holes 29 penetrating through the terminal holding wall 26.

The locking protrusions 28 are rectangular protrusions in conformity with the shape of the locking holes 21B.

The fixing holes 29 have a circular shape so that shaft portions of bolts BT are insertable therethrough.

The engaging frames 30 are fixed to the terminal holding wall 26 by engaging opposite ends of U-shaped frame bodies projecting like claws with the inner walls of mounting recesses 31 provided on the terminal holding wall 26.

The second housing 33 includes three terminal accommodating chambers 34 provided in correspondence with the respective connecting members 20 and the three terminal accommodating chambers 34 are united on a rear side.

Figure 13:
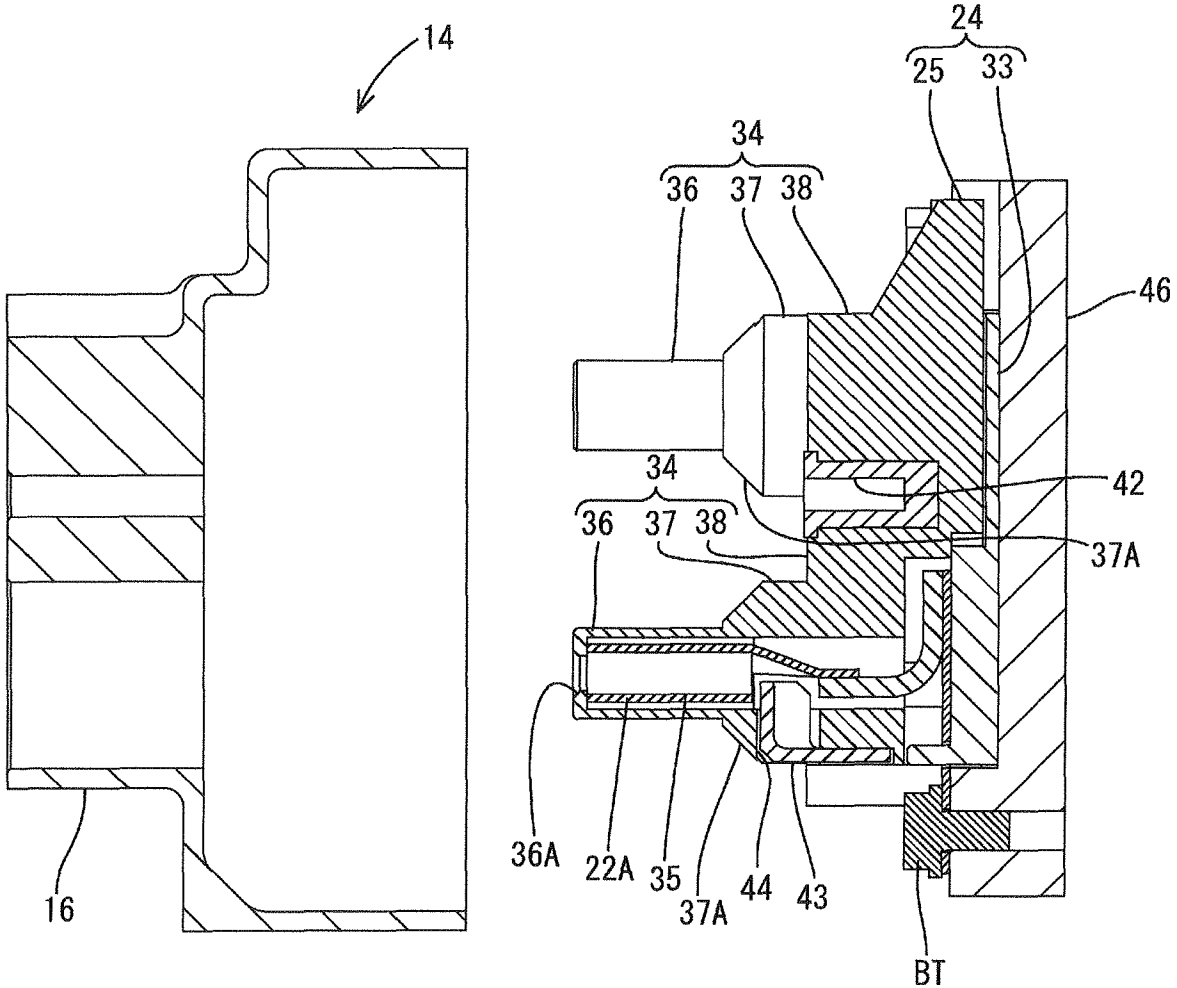
FIG. 13 is a vertical section showing a state where the device-side connector is mounted on the holder.
Figure 14:
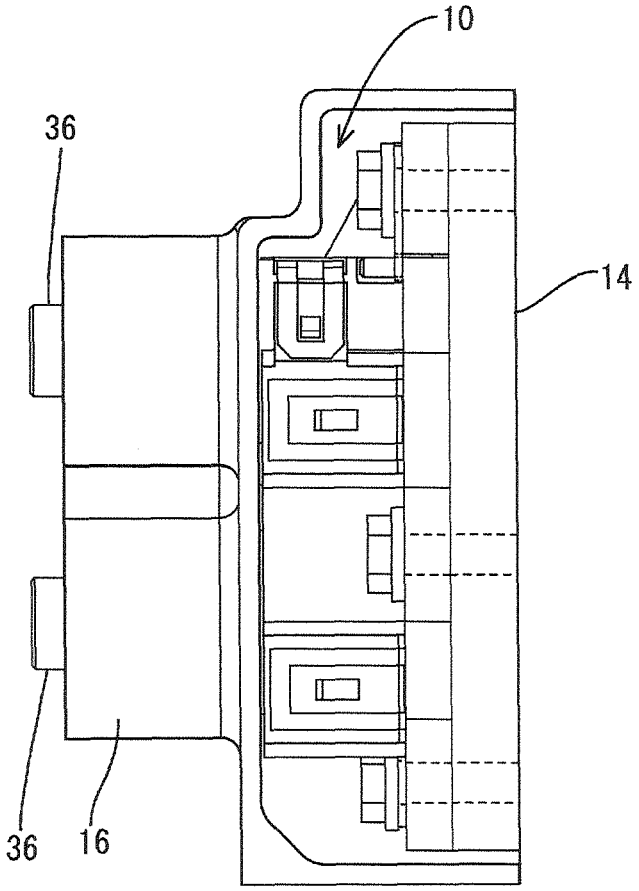
FIG. 14 is a side view showing a state where the shield case is mounted over the device-side connector on the holder.
Figure 15:
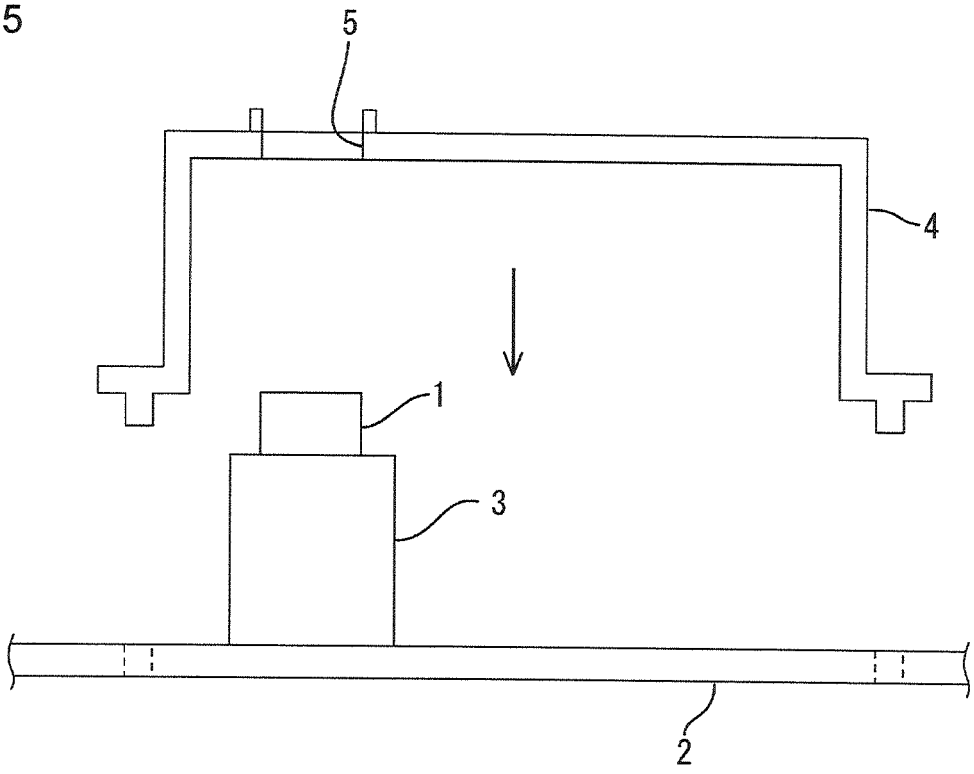
FIG. 15 is a side view showing a mounted state of a shield case on a base member of a device.

As shown in FIG. 13, each terminal accommodating chamber 34 includes a terminal accommodating hole 35 inside, a tubular accommodating portion 36 provided on a front side, a widened portion 37 widened behind the terminal connecting portion 36 and an integral wall portion 38 formed by uniting three widened portions 37 behind the widened portions 37.

The tubular accommodating portion 36 has a cylindrical shape so that the tubular terminal connecting portion 22A is insertable thereinto, and a tip part thereof is formed with a terminal insertion hole 36A through which a mating terminal is insertable.

The widened portion 37 has a tapered surface 37A on the outer peripheral surface. The tapered surface 37A is connected to the rear end of the tubular accommodating portion 36 and inclined at a uniform angle over the entire circumference. The diameter of the widened portion 37 is constant behind the tapered surface 37A.

As shown in FIG. 5, insertion recesses 39, through which the bolts BT are insertable, are formed on opposite lateral parts of the integral wall portion 38 by constricting the integral wall portion 38 in a width direction.

Engaging protrusions 40A projecting in the width direction are respectively formed above and below the insertion recess 39 on each of the side surfaces of the integral wall portion 38.

Each engaging protrusion 40A has such a triangular shape that a projecting distance from the side surface is reduced at a uniform rate toward the back from the front end standing perpendicularly from the side surface. A pair of guide walls 40B are provided above and below the engaging protrusion 40A. In assembling the two housings 25, 33, the engaging frames 30 of the first housing 25 inserted into inner sides between the guide walls 40B are guided by the guide walls 40B. When coming into contact with the engaging protrusions 40A, the engaging frames 30 move over the slopes of the engaging protrusions 40A while being resiliently deformed and are then resiliently restored.

Figure 11:
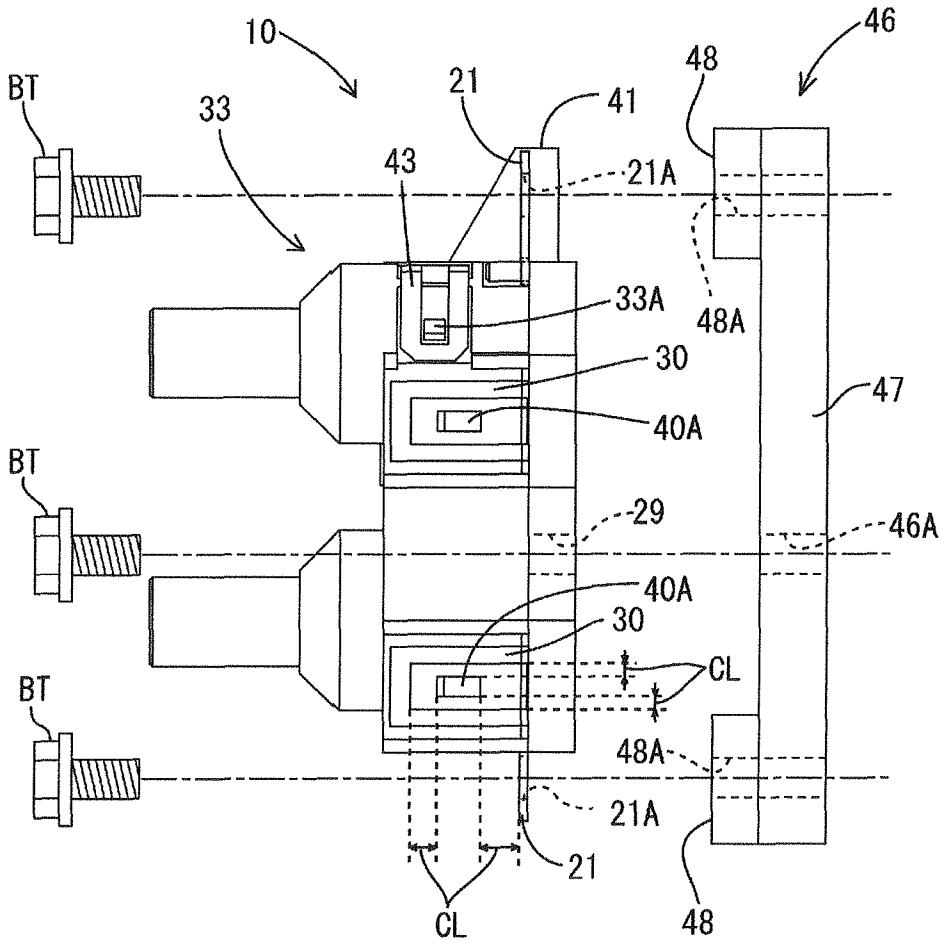
FIG. 11 is a side view showing the mounting of the device-side connector onto a holder.
Figure 11:
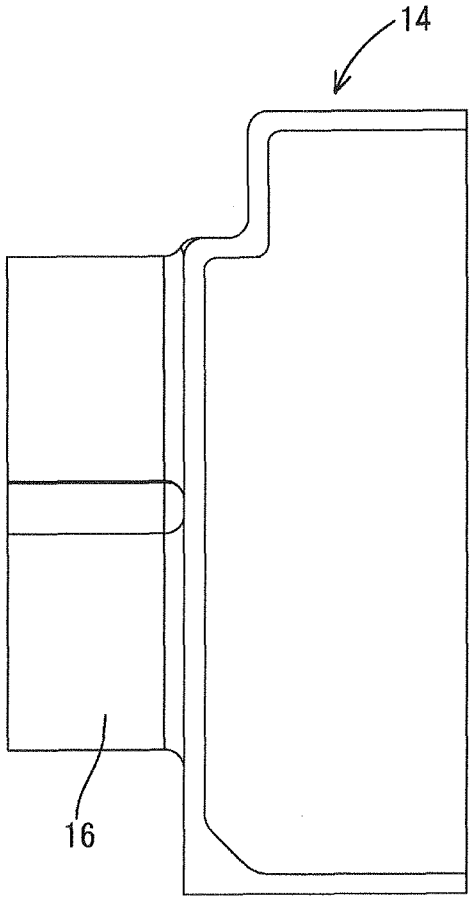

In this way, the engaging protrusions 40A are engageable with the engaging frames 30 with the predetermined clearance CL defined therebetween as shown in FIG. 11. In this way, the second housing 33 including the engaging protrusions 40A is not fixed in position with respect to the first housing 25 including the engaging frames 30 and movable within the range of the clearance CL.

Specifically, the second housing 33 is engageable with the first housing 25 with the predetermined clearance CL defined therebetween.

Fit-in walls 41 to be fitted into the groove portions 27 of the first housing 25 extend in the vertical direction and the lateral direction in correspondence with the positions of the groove portions 27 on the back surface side of the integral wall portion 38.

As shown in FIG. 13, a boss portion 42 formed with a screw hole for tightening the bolt 60 inserted through the wire-side connector 50 is formed in a central part of the front surface of the integral wall portion 38.

A retainer mounting hole 44 into which a retainer 43 is mountable is so provided on the outer surfaces of the terminal accommodating chambers 34 from the widened portions 37 to the integral wall portion 38 as to communicate with the terminal accommodating holes 35.

The retainer 43 includes holding protrusions for holding the second terminals 22 at proper positions by being engaged with the rear ends of the second terminals 22 and a pair of mounting frames to be retained by being engaged with locking protrusions 33A formed on the side surfaces of the second housing 33 as shown in FIG. 11.

The back surface side of the housing 24 (first housing 25) is fixed by the holder 46.

As shown in FIG. 5, the holder 46 is composed of a plate-like base portion 47 and terminal mount portions 48 projecting from the base portion 47.

Circular fixing holes 47A each having a screw groove formed on the inner peripheral surface are formed to penetrate through the base portion 47.

A circular terminal fixing hole 48A is formed on the upper surface of each terminal mount portion 48. A screw groove is formed on the inner peripheral surface of the terminal fixing hole 48A.

This holder 46 is fixed on the inner device 13, which is fixed on the base member 12 of the device 11 by fixing means such as bolts, by unillustrated mounting means, whereby the first housing 25 fixed to this holder 46 is fixed in position with respect to the base member 12.

Next, how to assemble and mount the device-side connector 10 are described.

The holder 46 is mounted and fixed on the inner device 13, which is fixed on the base member 12, by the unillustrated mounting means.

Subsequently, the first terminals 21 are arranged on the terminal holding wall 26 of the first housing 25 so that the locking protrusions 28 of the first housing 25 are engaged with the locking holes 21B of the first terminals 21 of the connecting members 20.

Subsequently, the first housing 25 and the second housing 33 are so assembled into the housing 24 that the second terminals 22 are accommodated into the tubular accommodating portions 36 of the second housing 33, the fit-in walls 41 are fitted into the groove portions 27 and the engaging frames 30 are engaged with the engaging protrusions 40A. In this way, the device-side connector 10 is formed (FIG. 11). At this time, since being engaged with the first housing 25 within the range of the predetermined clearance CL in the vertical direction and forward and backward directions, the second housing 33 is permitted to be displaced from the first housing 25.

Figure 12:
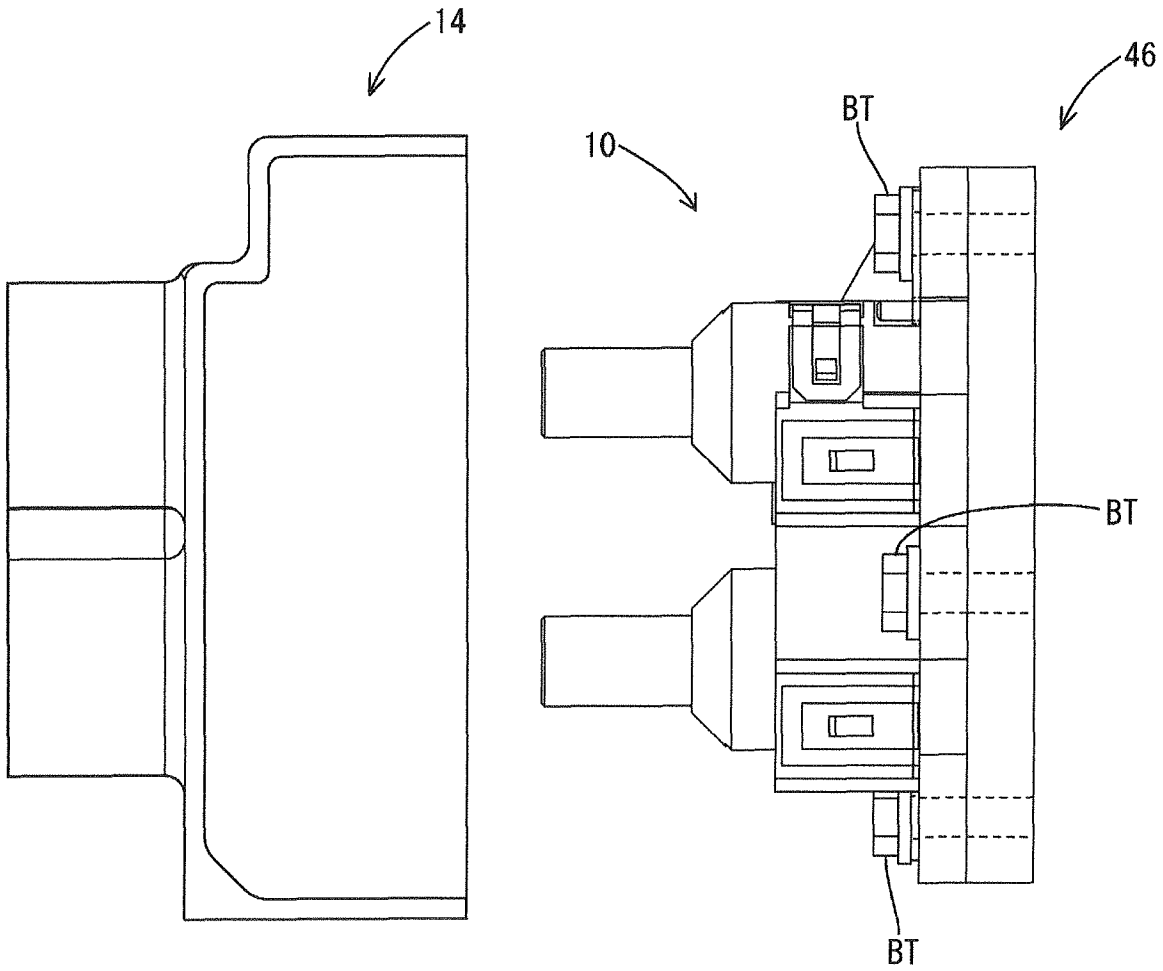
FIG. 12 is a side view showing a state where the device-side connector is mounted on the holder.

Subsequently, the first housing 25 is fixed to the holder 46 by inserting the shaft portions of the bolts BT into the fixing holes 29 of the first housing 25 and the fixing holes 47A of the holder 46. In addition, since the terminal fixing holes 21A of the first terminals 21 are aligned with the terminal fixing holes 48A, the holder 46 is tightened by the bolts BT inserted into these holes (FIG. 12).

Subsequently, the shield case 14 is so mounted on the device-side connector 10 that the tube portions 16 of the shield case 14 are fitted onto the tubular accommodating portions 36 of the second housing 33. At this time, even if the second housing 33 and the shield case 14 are displaced from each other due to a dimensional accuracy error or the like, the rear ends of the tube portions 16 come into contact with the tapered surfaces 37A and (the tubular accommodating portions 36 of) the second housing 33 is shifted to be aligned with (the tube portions 16 of) the shield case 14. Thus, the shield case 14 can be mounted (at a proper position). Then, the shield case 14 is fixed to the base member 12 by the fixing means 17B such as bolts.

According to the configuration of this embodiment, the following effects are achieved.

The device-side connector 10 (connector) is a connector to be connected to the mating connector by being mounted into the shield case 14 of the device 11 including the base member 12 and the shield case 14 (case) fixed to the base member 12, and includes the first terminals 21, the first housing 25 fixed in position with respect to the base member 12 and configured to hold the first terminals 21, the second terminals 22 to be connected to the first terminals 21 via the flexible conductive members 23, and the second housing 33 configured to hold the second terminals 22 and engageable with the first housing 25 with the predetermined clearance CL defined therebetween.

If both the shield case 14 and the connector are fixed to the base member 12, an assembling trouble may occur due to a dimensional accuracy error or the like in mounting the connector into the shield case 14. On the other hand, according to this embodiment, the shield case 14 and the first housing 25 are both fixed to the base member 12, but the second housing 33 is engaged with the first housing 25 with the predetermined clearance CL defined therebetween. Thus, even if a dimensional accuracy error or the like occurs between the shield case 14 and the connector in mounting the shield case 14, the second housing 33 is engaged with the first housing 25 within the range of the clearance CL, whereby a displacement of the second housing 33 is permitted according to the clearance CL and the dimensional accuracy error between the shield case 14 and the device-side connector 10 can be resolved. Thus, a trouble in mounting the shield case 14 due to a dimensional accuracy error or the like can be prevented.

Further, since the second terminals 22 held in the second housing 33 are connected to the first terminals 21 held in the first housing 25 via the flexible conductive members 23, the second terminals 22 can follow a displacement of the second housing 33 even if the second housing 33 is displaced from the first housing 25, and a trouble and the like at the time of connection to the wire-side connector 50 due to the positions of the second terminals 22 can also be prevented.

Since the predetermined clearance CL is formed by the engagement of the engaging frames 30 (engaging recess) provided on one of the first and second housings 25, 33 and the engaging protrusions 40A provided on the other of the first and second housings 25, 33, the second housing 33 can be engaged with the first housing 25 with the predetermined clearance CL defined therebetween by a simple configuration.

Since the second housing 33 is formed with the tapered surfaces 37A that can come into contact with the shield case 14 in mounting the shield case 14, even if the shield case 14 is displaced from the second housing 33 in being mounted, the second housing 33 can be displaced to a position where the shield case 14 can be mounted when the shield case 14 comes into contact with the tapered surfaces 37A.

The present invention is not limited to the above described and illustrated embodiment. For example, the following embodiments are also included in the technical scope of the present invention.

Although the connector of the present invention is the device-side connector 10 provided in the device 11 such as an inverter device of a vehicle in the above embodiment, there is no limitation to this. For example, it may be a connector provided in another device such as a motor other than the inverter device and the present invention can also be applied to a connector provided in a device of something other than a vehicle. Further, depending on the type of the device, various members are also applicable for the base member to which the connector and the case are fixed.

Although the shield case 14 is used in the above embodiment, the present invention can also be applied to a case having no shield function depending on the type or the like of the device.

Although the engaging frames 30 are engaged with the engaging protrusions 40A in the above embodiment, there is no limitation to this. As long as the first and second housings 25, 33 are engaged with the predetermined clearance defined therebetween, engaging recesses provided on one housing instead of the engaging frames 30 may be engaged with the engaging protrusions 40A provided on the other housing.

Although the second terminals 22 are illustrated to be tubular terminals in the above embodiment, the present invention can also be applied to differently shaped second terminals without being limited to this.

The invention claimed is:

1. A connector to be connected to a mating connector by being mounted into a case of a device including a base member and the case fixed to the base member, comprising:

a first terminal;

a first housing fixed in position with respect to the base member and configured to hold the first terminal;

a second terminal connected to the first terminal via a flexible conductive member; and a second housing configured to hold the second terminal and engageable with the first housing with a predetermined clearance defined therebetween, wherein the predetermined clearance is formed by engagement of an engaging recess provided on one of the first and second housings and an engaging protrusion provided on the other of the first and second housings.

2. The connector of claim 1, wherein the second housing is formed with a tapered surface capable of coming into contact with the case in mounting the case.

3. The connector of claim 2, wherein the first terminal is fixed to a holder fixed in position with respect to the base member.

4. The connector of claim 1, wherein the first terminal is fixed to a holder fixed in position with respect to the base member.

5. A connector to be connected to a mating connector by being mounted into a case of a device including a base member and the case fixed to the base member, comprising:

a first terminal;

a first housing fixed in position with respect to the base member and configured to hold the first terminal;

a second terminal connected to the first terminal via a flexible conductive member; and a second housing configured to hold the second terminal and engageable with the first housing with a predetermined clearance defined therebetween, wherein the second housing is formed with a tapered surface capable of coming into contact with the case in mounting the case.

6. The connector of claim 5, wherein the first terminal is fixed to a holder fixed in position with respect to the base member.

* * * * *